United States Patent [19]

Jung et al.

[11] 4,407,210

[45] Oct. 4, 1983

[54] TWIN NEEDLE WITH ADJUSTABLE THROAT PLATE AND FEED PLATE

[75] Inventors: Wilhelm H. Jung, Mechanicsville; George P. Diacont, Jr., Richmond, both of Va.

[73] Assignee: AMF Incorporated, White Plains, N.Y.

[21] Appl. No.: 367,148

[22] Filed: Apr. 9, 1982

[51] Int. Cl.[3] ..... D05B 1/08

[52] U.S. Cl. ..... 112/167; 112/297; 112/260

[58] Field of Search ..... 112/166, 167, 163, 164, 112/155, 260, 296, 297

[56] References Cited

U.S. PATENT DOCUMENTS

| | | | |
|---|---|---|---|
| 1,605,385 | 11/1926 | Bebel | 112/167 |
| 3,602,167 | 8/1971 | Papajewski | 112/167 |
| 4,043,283 | 8/1977 | Jung | 112/163 |
| 4,221,181 | 9/1980 | Totino | 112/260 |
| 4,256,048 | 3/1981 | Jung | 112/297 |

*Primary Examiner*—H. Hampton Hunter

*Attorney, Agent, or Firm*—David E. Dougherty; Charles J. Worth

[57] ABSTRACT

In a twin needle tacker in which one needle/bobbin assembly is movable relative to the other to change the space between the tacks, a feed plate assembly and a throat plate assembly each having one plate movable relative to the other for realigning the slots of the feed plate assembly and the needle holes of the throat plate assembly with the needles; and a twin knife mechanism operatively interconnected having a first cutting means mounted on the bottom of one throat plate and the other cutting means mounted on the bottom of the other throat plate.

11 Claims, 7 Drawing Figures

TWIN NEEDLE WITH ADJUSTABLE THROAT PLATE AND FEED PLATE

This invention relates generally to sewing machines or apparatus and more particularly to twin needle machines.

Such a machine is shown, described and claimed in my U.S. Pat. No. 4,043,283 granted Aug. 23, 1977 and made part of the present disclosure by reference thereto. As shown, a throat plate is provided with a pair of needle holes appropriately spaced for alignment with a pair of spaced apart needle/bobbin assemblies. The machine is programmed to appropriately stitch or double tack a workpiece which is moved by a feed plate having an aligned spaced pair of slots. The needle/bobbin assemblies are adapted to be moved horizontally relative to one another to vary the spacing between the stitches or tacks. However, when this occurs, the needle holes and slots of the throat and feed plates, respectively, are no longer suitably aligned with the needles and these plates must be changed. This necessitates having two sets of plates for various changes of spacing.

This becomes more involved and costly when the throat plate is provided with a twin knife mechanism as shown, described and claimed in my U.S. Pat. No. 4,256,048 granted Mar. 17, 1981 and is made a part of the present disclosure by reference thereto.

The present invention contemplates an improvement to the machine of U.S. Pat. No. 4,043,283 by providing divided throat and feed plates, each having one portion movable relative to the other to properly align the needle holes and slots to the adjusted needle/bobbin assemblies. The divided throat plate also is provided with a pair of thread cutting means as in my U.S. Pat. No. 4,256,048 with one of the cutting means having an adjustable mounting to compensate for movement of the throat plate portion.

Accordingly, an object of the present invention is to provide a twin needle sewing machine which is adjustable to vary the spacing between the two lines of stitches.

Another object of the present invention is to provide the foregoing machine with an adjustable feed plate.

And another object of the present invention is to provide the foregoing machine having an adjustable throat plate with a pair of interconnected thread cutting means each cooperating with one of the needle/bobbin assemblies of the machine.

The foregoing and other objects and advantages will appear more fully hereinafter from a consideration of the detailed description which follows, taken together with the accompanying drawings, wherein a single embodiment of the invention is illustrated by way of example. It is to be expressly understood, however, that the drawings are for illustration purposes only and are not to be construed as defining the limits of the invention.

Figure 1:
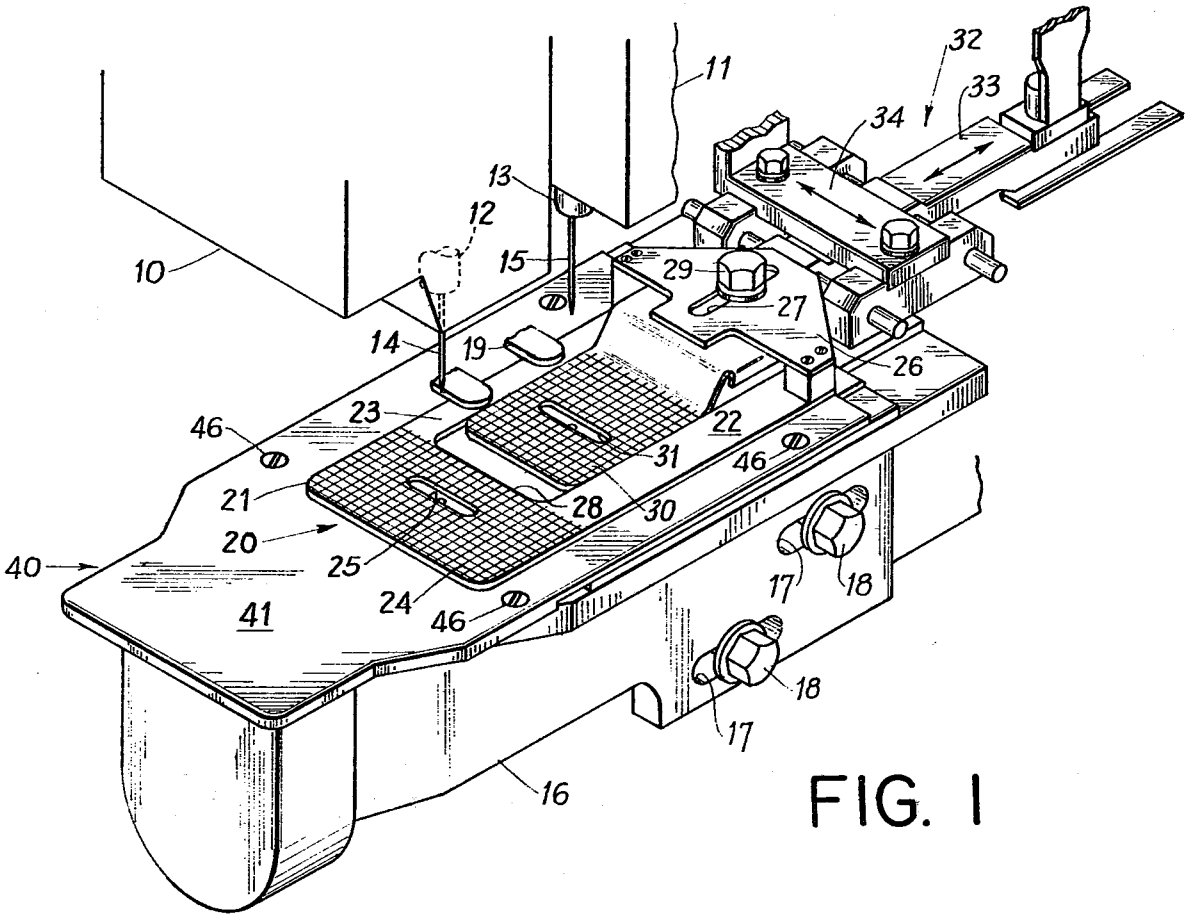
FIG. 1 is a perspective view of the working end of a twin needle sewing machine made in accordance with the present invention.
Figure 6:
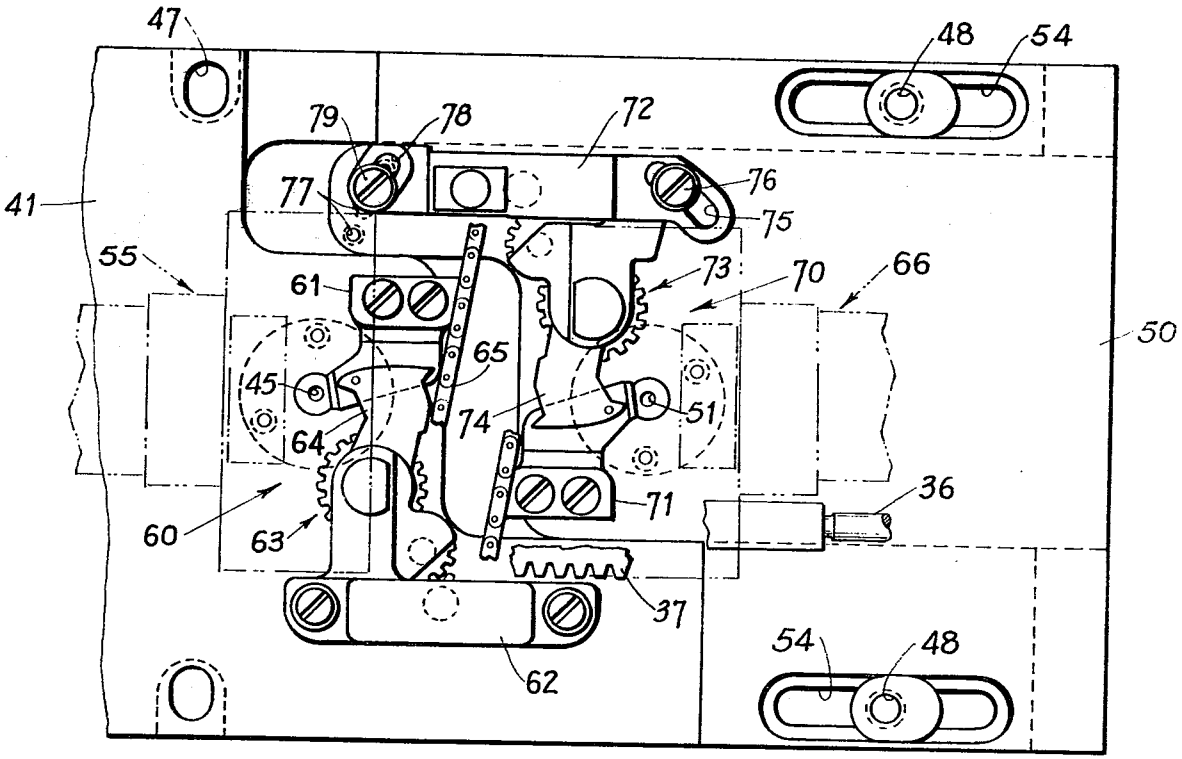
FIGS. 6 and 7 are enlarged fragmentary bottom plan views of the throat plate assembly with alternative arrangements of the knife mechanism.
Figure 7:
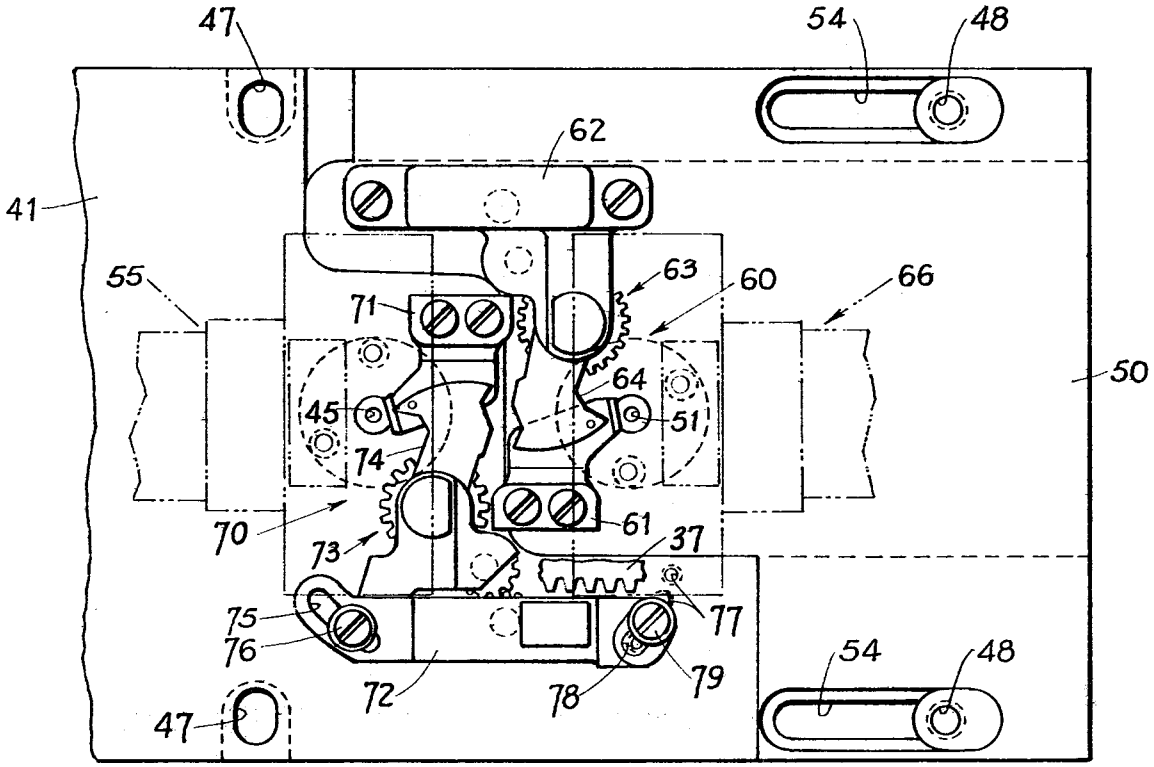

Referring now to the drawings and particularly to FIG. 1, a sewing machine or apparatus (shown in part) has a head formed by needle bar housings 10 and 11 with drive means (not shown) for reciprocally driving needle bars 12 and 13 provided with needles 14 and 15, respectively. A work support table or bed is formed by a throat plate assembly 40 mounted on a front frame or housing 16 enclosing a pair of bobbin/shuttle assemblies 55 and 66 (as indicated in FIGS. 6 and 7). It should be understood that means for driving and adjusting the spacing between the needles and between the bobbin assemblies are shown and described in my U.S. Pat. No. 4,043,283. Both sides (only one shown) of the frame or housing 16 is provided with a pair of longitudinal slots 17 and a fastener 18 extending through each of the slots for releasably holding the front housing in place or from movement relative to the main frame or housing of the machine (as disclosed by U.S. Pat. No. 4,043,283).

FEED PLATE ASSEMBLY

Figure 2:
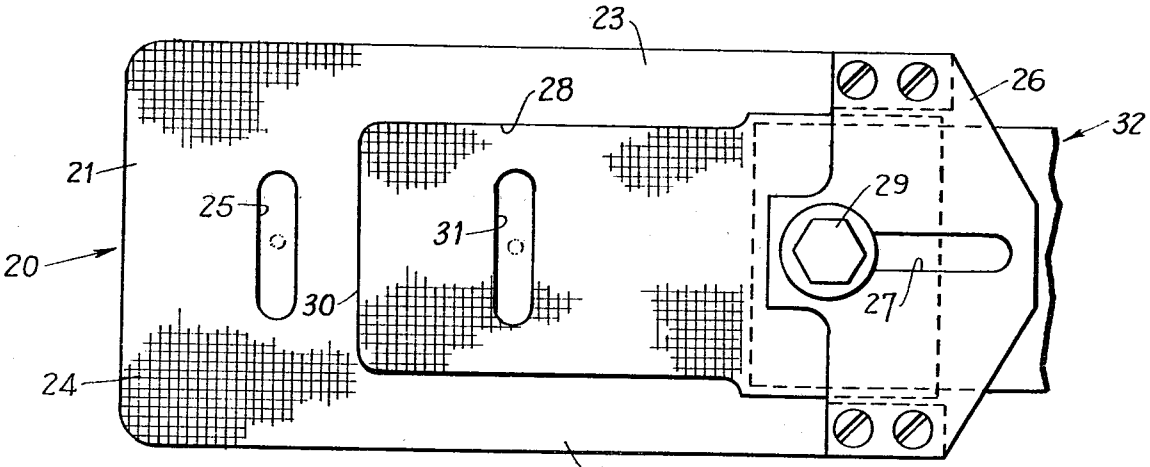
FIGS. 2 and 3 are enlarged plan views of the feed plate assembly when in a closed position and in the extended position, respectively.
Figure 3:
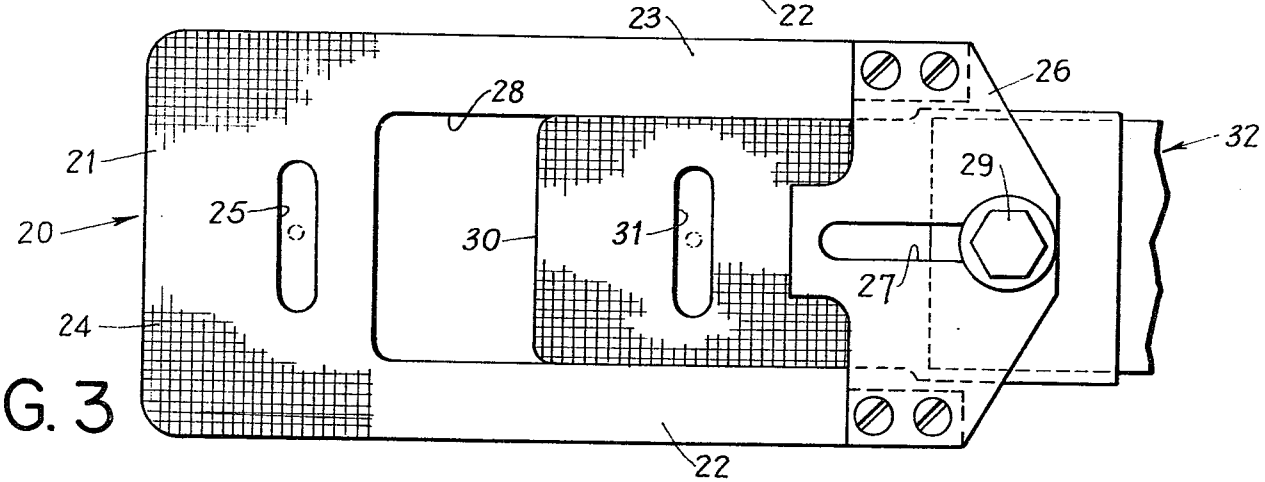
Figures 4, 5:
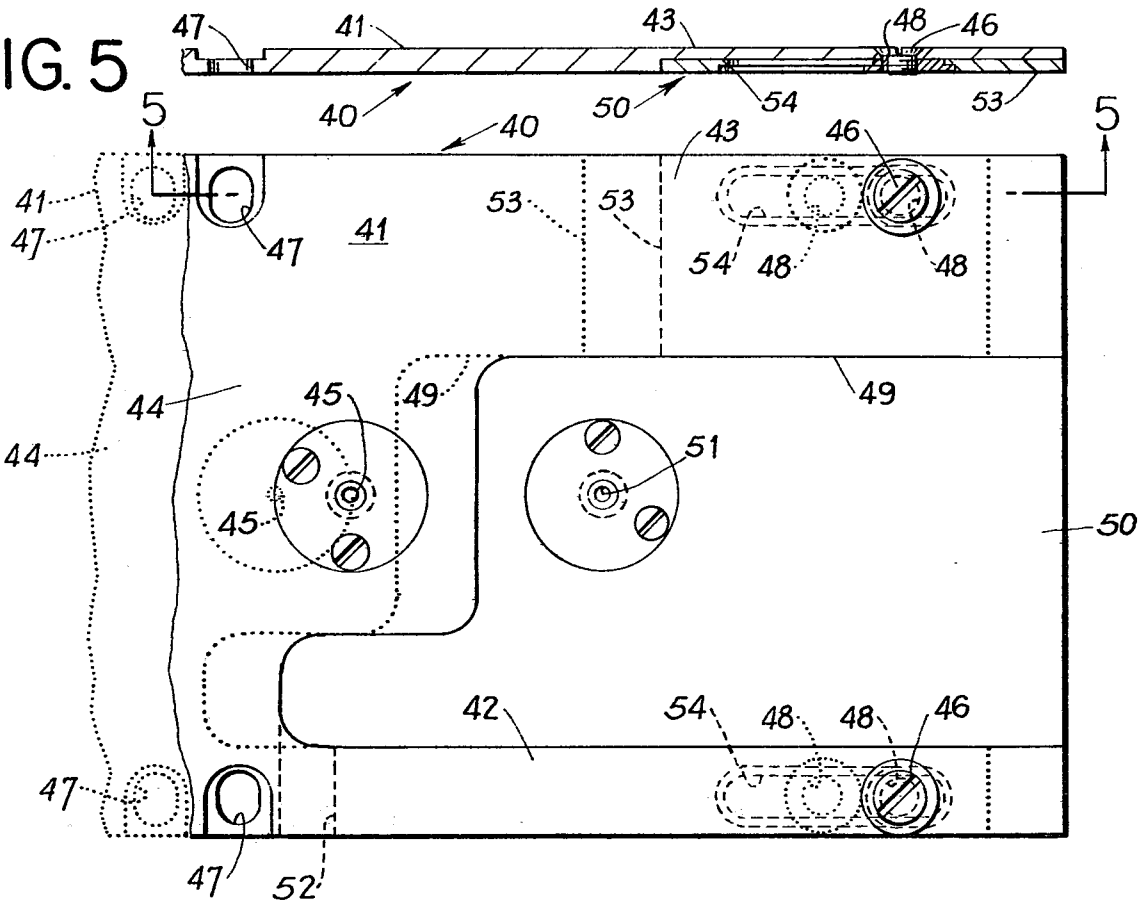
FIG. 4 is an enlarged fragmentary plan view of the throat plate assembly.
FIG. 5 is a sectional view taken on line 5—5 of FIG. 4.

Referring also to FIGS. 2 and 3, a clamp assembly having fingers 19 cooperating with a clamp or feed plate assembly 20 is provided for holding and feeding a workpiece on the throat plate assembly 40 in accordance with a predetermined pattern to be sewn or tacked by needles 14 and 15. The clamp or feed plate assembly 20 is formed by a pair of plates or plate members 21 and 30 substantially disposed in a common horizontal plane and releasably connected at their inner ends by a fastener 29 to feed driving means 32 having a longitudinal input member 33 and lateral input member 34.

More particularly, plate 21 has a laterally spaced pair of longitudinally extending leg portions 22 and 23 connected at their outer ends by a bight 24 having a laterally extending needle slot 25 aligned with the needle 14. A plate or adaptor 26, having a central longitudinally extending slot 27, is connected to the inner ends of legs 22 and 23 which with the bight 24 define a longitudinal slot or slideway 28. The plate member 30, disposed in the slot or slideway 28, has a laterally extending needle slot 31 aligned with the needle 15 and an inner end which extends under the plate or adaptor member 26. A fastener 29 extends through the slot 27 and an opening in the inner end of plate 30 to connect the plates 21 and 30 to the drive means 32. When the space between needles is changed, the fastener 29 is loosened and because of the slot 27, the plate 21 is movable longitudinally in the slideway 28 relative to plate 30 to appropriately change the spacing and realign the needle holes 25 and 31 for the new relative positions of needles 14 and 15.

THROAT PLATE ASSEMBLY

The throat plate assembly 40 is formed by an outer plate 41 and an inner plate 50 of equal thickness disposed in substantially a common plane to provide a smooth surface supporting the feed plate assembly 20. The plate 41 has a pair of laterally spaced legs 42 and 43 connected together at their outer ends by a bight 44 having a needle hole 45 aligned with the needle 14. A pair of fasteners 46 extend through holes 47 forward of the legs 42 and 43 which are provided with similar holes 48 at their other ends. The legs or leg portions 42 and 43 with the bight 44 define a slot or slideway 49 for an inner throat plate member 50 having a needle hole 51 aligned with the needle 15. The throat plate 50 disposed in the slot or slideway 49, which provides a needle hole 51, extends laterally therefrom overlapping portions 52 and 53 of plate 50 and legs 42 and 43 are reduced in thickness so their combined thickness is substantially equal to the normal thickness of plates 41 and 50. The plate 50 is also provided with a pair of longitudinally extending slots 54 aligned with holes 48 of the plate 40.

Normally, fasteners 18 clamp and hold the frame 16 in position while fasteners 46 extending through forward holes 47 and additional fasteners 46 extending through the rear holes 47 and slots 48 immovably hold plates 41 and 50 on frame 16. The slots 25 and 31 aligned with needles 14 and 15, respectively, are thereby spaced or aligned to continuously expose a pair of spaced needle holes 45 and 51 provided by the throat plates 41 and 50 during movement of the feed plate assembly 20 during sewing.

To realign needle holes 45 and 51 after the spacing between needles 14 and 15 is changed, fasteners 18 are loosened and frame 16 is moved longitudinally with plates 41 and 50 to realign the needle hole 45 with needle 14 after which the fasteners 18 are tightened to hold frame 16 against movement. Fasteners 46 extending through holes 48 and slots 54 are loosened to permit longitudinal movement of plate 50 to realign the needle hole 51 with the needle 15. The loosened fasteners 46 are retightened, and the plates 41 and 50 are thereby locked in position with needle holes 45 and 51 aligned with needles 14 and 15, respectively. In effect, the outer plate has been moved to reposition the needle hole 45 while the inner plate 50 should be in its original position. Alternatively, fasteners 46 through holes 48 and slots 54 can be loosened prior to moving frame 16. Therefore, the inner plate 50 would be held in position with needle hole 51 aligned with needle 15 while the frame 16 with the outer plate 41 are moved longitudinally to realign needle hole 45 with the needle 14. Of course, when needle holes 45 and 51 are realigned, the slots 25 and 31 of the feed plate assembly require realignment.

KNIFE APPARATUS

A knife apparatus for simultaneously cutting both bobbin and needle threads generally of the type shown, described and claimed in my U.S. Pat. No. 4,256,048 is mounted on the bottom of the throat plate assembly 40. The knife apparatus of the patent provides a fixed blade adjacent each needle hole and a rotatable blade driven by a gear train, causing each rotatable blade to rotate first in one direction to pick the threads extending through an adjacent needle hole and then in the opposite direction to cooperate with the adjacent fixed blade to cut the picked threads. An endless belt or chain interconnects the gear trains, and would prevent displacement of each of the cutting mechanisms from the other which would be necessary when the spacing between the needle holes is changed. To compensate for such displacement in the present construction, one assembly or cutting mechanism is fixedly mounted on one of the throat plates and an adjustable assembly of cutting mechanism is mounted on the other of the throat plates.

Referring now to FIG. 6, a knife assembly 60 is provided with a blade 61 fixedly mounted on the plate 41 adjacent the needle hole 45, and a gear train 63 is mounted on the plate 41 by a bracket 62. A push/pull rod 36 from the program control of the machine is provided at its end with a rack gear 37 in mesh with the first or input gear of the gear train 63, while a movable blade 64 is mounted for rotation on the same center for and with the last or output gear of the gear train 63. When the push/pull rod 36 is pushed (to the left in FIG. 6), a gear train 63 causes the blade 64 to rotate counterclockwise across the fixed blade 61 and needle hole 45 to pick the treads thereat. When the rod 36 is pulled or moved back, blade 64 with the picked threads is rotated clockwise across the edge of the fixed blade 61 which cuts the picked threads.

The other knife assembly 70 is provided with a blade 71 fixedly mounted on the plate 50 adjacent the needle hole 51 and a gear train 73 mounted on the plate by a generally T-shaped bracket 72. The bracket 72 is provided with slots 75 and 78 at the ends of its arms and is releasably connected to the plate 50 by a fastener 76 extending through slot 75 and a fastener 79 extending through slot 78 into one of a series of holes 77 in the plate 50. A link roller chain or endless belt 65 connects a pair of gears or sprockets rotatable with and one the same axes as the input gears of gear trains 63 and 73.

When one of the plates 41 or 50 is to be moved related to the other, fasteners 76 and 79 are loosened to permit the bracket 72 to rotate on the end of its leg about the same axis of rotation of the output gear of the gear train 73 and rotatable blade 74 which coacts with fixed blade 71 in the same manner as blade 64 coacts with fixed blade 61. When the plates 41 and 50 are secured, fasteners 76 and 79 are again tightened to hold the bracket 72 in place. As should be readily understood, gear trains 63 and 73 connected by chain 65 to operate together in response to movement of the push/pull rod 36 causes blades 64 and 74 to rotate counterclockwise simultaneously to pick both bobbin and needle threads extending through the respective needle holes 45 and 51 and then to rotate clockwise simultaneously coacting with fixed blades 61 and 71 to cut the picked threads. The push/pull rod 36 may be provided with length adjusting means well known in the art if required.

As shown in FIG. 7, the fixed knife assembly 60 is mounted on the bottom of plate 50 while the adjustable knife assembly 70 is mounted on the bottom of plate 41, and will work in exactly the same manner as described above with reference to FIG. 6.

Although but a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. In a sewing machine having a spaced pair of needles reciprocally driven for sewing and means for changing the space between said needles, throat plate means providing a spaced pair of needle holes each aligned with a different one of said needles and means for changing the space between and realigning said needle holes when the space between said needles is changed, feed plate means above said throat plate means and moved for feeding material during sewing, said feed plate means having a spaced pair of slots aligned to continuously expose said spaced pair of needle holes during sewing and means for changing the spacing between and realigning said slots when the space between said needles is changed.

2. In a sewing machine in accordance with claim 1, and a pair of thread picking and cutting means connected to the bottom of said throat plate means between said spaced pair of needle holes and comprising a pair of fixed blades each disposed adjacent a different one of said needle holes, a pair of rotatable blades each rotated past a different one of said fixed blades and the adjacent needle hole for picking the needle and bobbin threads thereat and cooperating with said fixed blade when rotated back to its original position to cut the picked threads, a pair of gear trains each rotatably driving a different one of said rotatable blades, means for driving one of said gear trains at the end of a sewing cycle, means operatively connecting said gear trains together, a fixed bracket mounting said one of said gear trains and said blade rotated thereby to the bottom of said throat plate means, and another bracket mounting the other of said gear trains and said blade rotated thereby to the bottom of said throat plate means and being pivotal on the axis of rotation of said blade when the space between said needle holes is changed.

3. In a sewing machine in accordance with claim 1, and having feed drive means, said feed plate means comprising a pair of plates disposed in a common plane each providing one of said pair of slots, means connecting said pair of plates at one end of said feed plate means to said feed drive means and being releasable for permitting moving said plate relative to one another and change the space between said slots.

4. In a sewing machine in accordance with claim 3, and one of said pair of plates being U-shaped having a pair of spaced parallel legs connected by a bight at one end providing one of said slots and means connecting the other ends of said legs together, the other of said pair of plates disposed between said pair of parallel legs having a slot adjacent the end closer to said bight and being releasably connected at its other end with said means connecting the ends of said pair of legs to said feed drive means.

5. In a sewing machine in accordance with claim 4, and a pair of thread picking and cutting means connected to the bottom of said throat plate means between said spaced pair of needle holes and comprising a pair of fixed blades each disposed adjacent a different one of said needle holes, a pair of rotatable blades each rotated past a different one of said fixed blades and the adjacent needle hole for picking the needle and bobbin threads thereat and cooperating with said fixed blade when rotated back to its original position to cut the picked threads, a pair of gear trains each rotatably driving a different one of said rotatable blades, means for driving one of said gear trains at the end of a sewing cycle, means operatively connecting said gear trains together, a fixed bracket mounting said one of said gear trains and said blade rotated thereby to the bottom of said throat plate means, and another bracket mounting the other of said gear trains and said blade rotated thereby to the bottom of said throat plate means and being pivotal on the axis of rotation of said blade when the space between said needle holes is changed.

6. In a sewing machine in accordance with claim 1, and including a bobbin frame connected to the frame of the machine, said throat plate means comprising a pair of plates mounted on said bobbin frame and having their top surfaces disposed in a common plate supporting said feed plate means, each of said pair of plates having a needle hole aligned with a different one of said needles, and releasable means for permitting said plates to be moved relative to one another changing the space between and realigning said needle holes after the space between said needles is changed.

7. In a sewing machine in accordance with claim 6, and fastening means releasable to permit said bobbin frame to move moving said throat plates and permitting one of said plates to move relative to said frame and the other of said plates.

8. In a sewing machine in accordance with claim 7, and a pair of thread picking and cutting means connected to the bottom of said throat plate means between said spaced pair of needle holes and comprising a pair of fixed blades each disposed adjacent a different one of said needle holes, a pair of rotatable blades each rotated past a different one of said fixed blades and the adjacent needle hole for picking the needle and bobbin threads thereat and cooperating with said fixed blade when rotated back to its original position to cut the picked threads, a pair of gear trains each rotatably driving a different one of said rotatable blades, means for driving one of said gear trains at the end of a sewing cycle, means operatively connecting said gear trains together, a fixed bracket mounting said one of said gear trains and said blade rotated thereby to the bottom of said throat plate means, and another bracket mounting the other of said gear trains and said blade rotated thereby to the bottom of said throat plate means and being pivotal on the axis of rotation of said blade when the space between said needle holes is changed.

9. In a sewing machine in accordance with claim 7, and having feed drive means, said feed plate means comprising a pair of plates disposed in a common plane each providing one of said pair of slots, means connecting said pair of plates at one end of said feed plate means to said feed drive means and being releasable for permitting moving said plates relative to one another and change the space between said slots.

10. In a sewing machine in accordance with claim 9, and one of said pair of plates being U-shaped having a pair of spaced parallel legs connected by a bight at one end providing one of said slots and means connecting the other ends of said legs together, the other of said pair of plates disposed between said pair of parallel legs having a slot adjacent the end closer to said bight and being releasably connected at its other end with said means connecting the ends of said pair of legs to said feed drive means.

11. In a sewing machine in accordance with claim 10, and a pair of thread picking and cutting means connected to the bottom of said throat plate means between said spaced pair of needle holes and comprising a pair of fixed blades each disposed adjacent a different one of said needle holes, a pair of rotatable blades each rotated past a different one of said fixed blades and the adjacent needle hole for picking the needle and bobbin threads thereat and cooperating with said fixed blade when rotated back to its original position to cut the picked threads, a pair of gear trains each rotatably driving a different one of said rotatable blades, means for driving one of said gear trains at the end of a sewing cycle, means operatively connecting said gear trains together, a fixed bracket mounting said one of said gear trains and said blade rotated thereby to the bottom of said throat plate means and being pivotal on the axis of rotation of said blade when the space between said needle holes is changed.

* * * * *